US007592046B2

(12) United States Patent
Mandai et al.

(10) Patent No.: US 7,592,046 B2
(45) Date of Patent: Sep. 22, 2009

(54) RECORDING MEDIUM

(75) Inventors: Shusaku Mandai, Ibaraki (JP); Yoshiaki Hirai, Ibaraki (JP)

(73) Assignee: Nippon Synthetic Chemical Industry Co., Ltd., Osaka-Fu (JP)

( * ) Notice: Subject to any disclaimer, the term of this patent is extended or adjusted under 35 U.S.C. 154(b) by 318 days.

(21) Appl. No.: 11/544,414

(22) Filed: Oct. 5, 2006

(65) Prior Publication Data

US 2007/0031614 A1 Feb. 8, 2007

Related U.S. Application Data

(62) Division of application No. 10/783,947, filed on Feb. 20, 2004, now abandoned.

(30) Foreign Application Priority Data

Feb. 21, 2003 (JP) ..... 2003-043771
Feb. 21, 2003 (JP) ..... 2003-043772

(51) Int. Cl.
*B05D 1/00* (2006.01)

(52) U.S. Cl. ..... 427/385.5

(58) Field of Classification Search ..... None
See application file for complete search history.

(56) References Cited

U.S. PATENT DOCUMENTS 5,082,730 A * 1/1992 Takeda et al. ..... 428/336
5,302,437 A 4/1994 Idei et al. ..... 428/32.22
5,589,259 A 12/1996 Hosoi et al. ..... 428/32.18
6,224,971 B1 5/2001 Tomizawa et al. ..... 428/32.38
2003/0186003 A1 10/2003 Nakano et al. ..... 428/32.1

FOREIGN PATENT DOCUMENTS

| | | |
|---|---|---|
| JP | 62-158084 | 7/1987 |
| JP | 01-156597 | 6/1989 |
| JP | 10-119423 | 5/1998 |
| JP | 10-217601 | 8/1998 |
| JP | 2001-328345 | 11/2002 |

OTHER PUBLICATIONS

Abstracts and translation of JP 01-150577, Jun. 1989.*
Abstracts and partial machine translation of JP 11-078220, Mar. 1999.*
* English translations of the Abstract of each document is attached to the document.

* cited by examiner

*Primary Examiner*—Erma Cameron
(74) *Attorney, Agent, or Firm*—Ware, Fressola, Van Der Sluys & Adolphson, LLP

(57) ABSTRACT

The present invention relates to a recording medium, particularly a recording medium for ink jet printing, in which the surface strength of the coating surface is strong, ink blurring when printing hardly occurs and water resistance after printing is excellent and a process for preparing the same. That is, the present invention is a recording medium having a coating layer comprising (A) a polyvinyl alcohol resin containing an acetoacetic ester group, (B) a zirconium compound and (C) an inorganic powder on the surface of a substrate. Also, the present invention is a process for preparing a recording medium which comprises a step of preparing a coating solution comprising a polyvinyl alcohol resin containing an acetoacetic ester group (A), a zirconium compound (B) and an inorganic powder (C) and a step of applying the coating solution to the surface of a substrate.

3 Claims, No Drawings

RECORDING MEDIUM

CROSS REFERENCE TO RELATED APPLICATIONS

This application is a divisional application of U.S. patent application Ser. No. 10/783,947, filed on Feb. 20, 2004, now abandoned which claims priority under 35 U.S.C. §119 from Japanese Patent Applications No. 2003-043771 and 2003-043772, both filed on Feb. 21, 2003. The aforementioned applications are incorporated herein by reference in their entirety.

BACKGROUND OF THE INVENTION

The present invention relates to a recording medium and a process for preparing the same. More specifically, the present invention relates to a recording medium, in which the surface strength of the coating surface is strong, ink blurring when printing hardly occurs, particularly when used for ink jet printing, and water resistance after printing is excellent, and a process for preparing the same.

In a recording medium in which a coating layer is formed on a substrate such as paper or resin film, often a coating layer containing inorganic powder is formed with the purpose of improving ink absorbency and whiteness. Examples of such recording mediums are a heat sensitive recording medium, to which recording is conducted by color developing a coloring substance such as crystal violet lactone and a developer such as a phenol compound by heat reaction, and a recording medium for ink jet printing, to which recording of symbols is conducted by spraying ink droplets from a nozzle and adhering and absorbing the ink to the surface of a substrate such as paper or resin film.

Particularly in recent years, the ink jet printing method is widely used in various printers because of the advantages of high-speed printing, multi-color printing and less sound when printing. With respect to the recording medium used for the ink jet printing method, improvement in coloring properties of the printing side and properties such as glossiness for providing high-quality appearance and ink absorbency for preventing stickiness of the printed area are in demand.

As a method to satisfy such demands, JP-A-62-158084 discloses a method of using a recording medium for ink jet printing having an ink receiving layer comprising fine particle silica as a main component and a recording surface which is dried by pressure welding to a heated mirror surface.

Also, the present applicant has suggested a recording medium for ink jet printing containing polyvinyl alcohol resin, titanate coupling agent and inorganic powder in the coating layer in order to improve the surface strength of the coating layer (ink receiving layer) (see JP-A-2001-328345) and a paper processing agent using polyvinyl alcohol resin having an acetoacetic ester group and zirconium salt in order to improve stiffness of paper (see JP-A-1-156597).

When using for ink jet printing, attempts have been made to add inorganic powder in the ink receiving layer, as in JP-A-62-158084 and JP-A-2001-328345. However, in order to improve ink absorbing speed and absorbing capacity, which are functions of inorganic powder, adjustments must be made such as reducing the amount of the binder. As a result, there is the problem of decrease in surface strength of the ink receiving layer.

Therefore, as in the art disclosed in JP-A-62-158084, by merely conducting mirror treatment to the surface, the surface strength of the ink receiving layer is still weak and there is the problem that during the process of preparing the recording medium, particularly when cutting, powder, which has partially peeled off and fallen from the ink receiving layer, or powder, which has fallen when printing, adheres to the nozzle causing clogging. Also, recently printing of images such as photographs is increasing and the problem of ink blurring when conducting this type of printing has newly arisen. Furthermore, when used as label for food packaging, in the case of strong contact in the presence of water, the printed area (ink receiving layer) may become damaged or peel off and problems may arise with respect to water resistance of the ink receiving layer. The art disclosed in JP-A-62-158084 has been found to be insufficient regarding this point.

Also, in art disclosed in JP-A-2001-328345, although some improvement in surface strength of the ink receiving layer can be expected, there is room for improvement with respect to ink blurring when printing and water resistance of the ink receiving layer after printing, as in the art disclosed in JP-A-62-158084.

The art disclosed in JP-A-1-156597 is excellent in surface strength of the coating layer but ink absorbency is insufficient, as inorganic powder is not used.

Consequently, not only excellent surface strength of the ink receiving layer, but also favorable ink absorbency, ink blurring prevention when printing and improved water resistance of the ink receiving layer after printing are desired.

SUMMARY OF THE INVENTION

The present invention relates to a recording medium having a coating layer comprising (A) a polyvinyl alcohol resin containing an acetoacetic ester group, (B) a zirconium compound and (C) an inorganic powder on the surface of a substrate.

In the recording medium, the zirconium compound (B) is preferably a zirconium nitrate compound.

In the recording medium, the zirconium compound (B) is preferably zirconyl hydroxychloride.

In the recording medium, the polymerization degree of the polyvinyl alcohol resin containing an acetoacetic ester group (A) is at least 300.

In the recording medium, the polyvinyl alcohol resin containing an acetoacetic ester group (A) is a reactant of a polyvinyl alcohol resin and a diketene.

The present invention also relates to a process for preparing a recording medium which comprises a step of preparing a coating solution comprising a polyvinyl alcohol resin containing an acetoacetic ester group (A), a zirconium compound (B) and an inorganic powder (C) and a step of applying the coating solution to the surface of a substrate.

In the process, the zirconium compound (B) is preferably a zirconium nitrate compound and the pH of the coating solution is preferably at most 3.5.

In the process, the zirconium compound (B) is preferably zirconyl hydroxychloride.

In the process, the polymerization degree of the polyvinyl alcohol resin containing an acetoacetic ester group (A) is preferably at least 300.

The process preferably further comprises a step of adjusting the pH of the coating solution to at most 3.5 by adding an inorganic acid (D), before the step of applying the coating solution to the surface of a substrate.

The process preferably further comprises a step of preparing polyvinyl alcohol resin containing an acetoacetic ester group (A) by reacting a polyvinyl alcohol resin and a diketene, before the step of preparing the coating solution.

Furthermore, the present invention relates to a recording medium for ink jet printing having a coating layer comprising (A) a polyvinyl alcohol resin containing an acetoacetic ester group, (B) a zirconium compound and (C) an inorganic powder on the surface of a substrate.

DETAILED DESCRIPTION

The present invention relates to a recording medium having a coating layer comprising (A) a polyvinyl alcohol resin containing an acetoacetic ester group (hereinafter referred to as AAPVA), (B) a zirconium compound and (C) an inorganic powder on the surface of a substrate and a process for preparing the same.

The AAPVA (A) used in the present invention is obtained by introducing an acetoacetic ester group to polyvinyl alcohol resin. The AAPVA (A) can be obtained by the method of reacting polyvinyl alcohol resin and diketene, the method of ester exchanging by reacting polyvinyl alcohol resin and acetoacetic ester or the method of hydrolyzing a copolymer of vinyl acetate and vinyl acetoacetate. From the viewpoints that the preparation process is simple, high-quality AAPVA can obtained and the amount of impurities such as acetoacetic ester, which influence the surface strength of the coating layer, is small, the method of reacting polyvinyl alcohol resin (powder) and diketene is preferable. The method of reacting polyvinyl alcohol resin (powder) and diketene is described below but the present invention is not limited to this method.

As the polyvinyl alcohol resin which is the raw material, a hydrolyzate obtained by hydrolyzing a lower alcohol solution of polyvinyl acetate by a hydrolyzing catalyst such as alkali or acid or a derivative thereof is usually used. Also, a hydrolyzate of copolymer comprising a monomer copolymerizable with a vinyl acetate and vinyl acetate can be used.

Examples of the monomer copolymerizable with vinyl acetate are olefins such as ethylene, propylene, isobutylene, α-octene, α-dodecene and α-octadecene; vinylene carbonates; unsaturated acids such as acrylic acid, methacrylic acid, crotonic acid, maleic acid, maleic anhydride and itaconic acid, salts thereof and mono or dialkylesters thereof; nitriles such as acrylonitrile and methacrylonitrile; amides such as acrylamide and methacrylamide; olefin sulfonic acid such as ethylene sulfonic acid, allyl sulfonic acid and methallyl sulfonic acid and salt thereof; alkyl vinyl ethers; N-acrylamidemethyltrimethyl ammonium chloride; allyltrimethyl ammonium chloride; dimethyldiallyl ammonium chloride; dimethylallyl vinyl ketone; N-vinylpyrrolidone; vinyl chloride; vinylidene chloride; polyoxyalkylene (meth)allyl ether such as polyoxyethylene (meth)allyl ether and polyoxypropylene (meth)allyl ether; polyoxyalkylene (meth)acrylate such as polyoxyethylene (meth)acrylate and polyoxypropylene (meth)acrylate; polyoxyalkylene (meth)acrylamide such as polyoxyethylene (meth)acrylamide and polyoxypropylene (meth)acrylamide; polyoxyethylene(1-(meth)acrylamide-1,1-dimethylpropyl)ester; polyoxyethylene vinyl ether; polyoxypropylene vinyl ether; polyoxyethylene allylamine; polyoxypropylene allylamine; polyoxyethylene vinylamine and polyoxypropylene vinylamine.

To react polyvinyl alcohol resin and diketene, the method of directly reacting polyvinyl alcohol resin and gaseous or liquid diketene; the method of reacting by absorbing organic acid in polyvinyl alcohol resin in advance and then spraying gaseous or liquid diketene in an inert gas atmosphere; or the method of reacting by spraying a mixture of organic acid and liquid diketene to polyvinyl alcohol resin can be used.

As the reaction device for conducting the reaction, any device which can be heated and is equipped with a stirrer is sufficient. For example, a kneader, Henschel mixer, ribbon blender or various other blenders or stirring and heating devices may be used.

The content of acetoacetic ester groups within the AAPVA (A) obtained by reacting polyvinyl alcohol resin and diketene is preferably 0.1 to 50% by mol, more preferably 0.3 to 40% by mol, particularly preferably 0.5 to 30% by mol. When the content is less than 0.1% by mol, sufficient water resistance may not be obtained. On the other hand, when the content is more than 50% by mol, water solubility tends to decrease and storage stability of the aqueous solution (coating solution) tends to decrease, thus being unpreferable.

The hydrolysis degree of AAPVA (A) is preferably at least 70% by mol, more preferably at least 75% by mol, particularly preferably at least 80% by mol. When the hydrolysis degree is less than 70% by mol, water solubility tends to become poor, thus being unpreferable.

The average polymerization degree (according to JIS K6726) of AAPVA (A) is preferably at least 300, more preferably at least 1200, further preferably 1200 to 4500, particularly preferably 1200 to 4000. When the average polymerization degree is less than 300, sufficient surface strength of the coating layer may not be obtained, thus being unpreferable.

As the zirconium compound (B), a zirconium nitrate compound or zirconyl hydroxychloride can be used.

Examples of the zirconium nitrate compound are zirconyl nitrate [$ZrO(NO_3)_2$], zirconium nitrate [$Zr(NO_3)_4$] and hydrates thereof. A commercial product of a hydrate of zirconium nitrate is for example "Zircosol ZN" available from Daiichi Kigenso Kagaku Kogyo Co., Ltd. When using a zirconium nitrate compound, the pH at 25° C. of the coating solution comprising AAPVA (A), the zirconium compound (B) and the inorganic powder (C) is preferably at most 3.5, more preferably 1 to 3.5, further preferably 1.5 to 3.5. When the pH is more than 3.5, surface strength of the coating layer and water resistance of the printed area after printing decrease, thus being unpreferable. The pH of the coating solution is preferably adjusted by adding an inorganic acid (D) and examples of the inorganic acid (D) are hydrochloric acid, sulfuric acid, nitric acid and phosphoric acid.

Zirconyl hydroxychloride is a compound represented by the formula ZrO(OH)Cl and hydrates thereof can be used as well. A commercial product of a hydrate of zirconyl hydroxychloride is for example "Zircosol ZC-2" available from Daiichi Kigenso Kagaku Kogyo Co., Ltd.

Examples of the inorganic powder (C) are synthetic silica, fumed silica, colloidal silica and alumina. Particularly, a silicone compounds such as amorphous synthetic silica and colloidal silica is preferably used. The inorganic powder (C) can be in a spherical form, granular form or powder form. The average particle size of the inorganic powder (C) is preferably 0.001 to 50 μm, more preferably 0.005 to 30 μm, particularly preferably 0.01 to 20 μm. When the average particle size is less than 0.001 μm, flowability of the coating solution decreases, thereby decreasing coating properties. Also, the ink dot diameter when printing becomes too small and the optical density may become light. On the other hand, when the average particle size is more than 50 μm, smoothness of the coating layer surface tends to decrease, thus being unpreferable. The surface of the inorganic powder (C) may be cation treated by an organic or inorganic substance.

In the present invention, the coating solution is prepared by compounding AAPVA (A), the zirconium compound (B) and the inorganic powder (C) into water. The compounding ratio of AAPVA (A), the zirconium compound (B) and the inorganic powder (C) in the coating solution is not particularly limited, but the zirconium compound (B) is preferably compounded in an amount of 0.01 to 10 parts by weight, more preferably 0.1 to 10 parts by weight, particularly preferably 1 to 5 parts by weight, based on 100 parts by weight of AAPVA (A). When the amount is less than 0.01 part by weight, improvement in surface strength of the coating layer cannot be sufficiently obtained and when the amount is more than 10 parts by weight, flowability of the coating solution decreases, thereby decreasing coating properties, thus being unpreferable.

The inorganic powder (C) is preferably compounded in an amount of 0.1 to 2000 parts by weight, more preferably 1 to 1000 parts by weight based on 100 parts by weight of AAPVA (A). When the amount is less than 0.1 part by weight, ink blurring may occur and when the amount is more than 2000 parts by weight, surface strength of the coating layer decreases, thus being unpreferable.

Naturally, in the case that transparency is required such as in film for OHP (overhead projector), the amount of the inorganic powder (C) is reduced. Specifically, the inorganic powder (C) is preferably compounded in an amount of 0.1 to 10 parts by weight based on 100 parts by weight of AAPVA (A). Also, in the case that whiteness is required such as in paper or ink absorbency is increased, the amount of the inorganic powder (C) is increased. Specifically, the inorganic powder (C) is preferably compounded in an amount of 10 to 50 parts by weight based on 100 parts by weight of AAPVA (A).

The method for preparing the coating solution of the present invention is not particularly limited. For example, the coating solution is prepared by the method of adding the inorganic powder (C) or an aqueous dispersion thereof to an aqueous solution of AAPVA (A), stirring to disperse and then adding an aqueous solution containing the zirconium compound (B); the method of adding the inorganic powder (C) or an aqueous dispersion thereof to an aqueous solution obtained by adding the zirconium compound (B) to an aqueous solution of AAPVA (A) and then stirring to disperse; the method of adding the inorganic powder (C) or an aqueous dispersion thereof to an aqueous solution obtained by adding an aqueous solution of AAPVA (A) to an aqueous solution containing the zirconium compound (B) and then stirring to disperse; or the method of dispersing the inorganic powder (C) in water, adding an aqueous solution of AAPVA (A) and the zirconium compound (B) and then stirring to disperse. An inorganic acid (D) can be added together with the zirconium compound (B).

The coating solution is applied on a substrate as an aqueous dispersion having solid content of preferably 1 to 70% by weight, more preferably 2 to 60% by weight, particularly preferably 5 to 50% by weight. When the solid content is less than 1% by weight, the adhering amount is small, optical density is light and surface strength of the coating layer is weak, thereby becoming impractical. On the other hand, when the solid content is more than 70% by weight, the viscosity of the coating solution becomes high and coating becomes difficult. Also, bumps develop in the coating, thus being unpreferable.

In the present invention, known additives such as a fixing agent, crosslinking agent, defoaming agent, release agent, surfactant (silicon-type, fluorine-type, polyethylene glycol-type), preservative, insect repellent, antirust agent, thickening agent and dispersant may be added to the coating solution within the range that the effects of the present invention are not inhibited.

Examples of the fixing agent are dicyan fixing agents (such as dicyandiamide-formalin polycondensate), polyamine fixing agents (such as aliphatic polyamine including diethylenetriamine, triethylenetetramine, dipropylenetriamine and polyallylamine, aromatic polyamine including phenylenediamine, condensate of dicyandiamide and (poly)$C_{2-4}$alkylenepolyamine including dicyandiamide-diethylenetriamine polycondensate) and polycation fixing agents. These fixing agents may be used alone or in a combination of two or more kinds. The amount of the fixing agent is preferably approximately 1 to 400 parts by weight based on 100 parts by weight of AAPVA (A).

Examples of the crosslinking agent are organic and inorganic crosslinking agents. Examples of the organic crosslinking agent are aldehyde compounds (such as formaldehyde, glyoxal and glutardialdehyde), amino resin (such as urea resin, guanamine resin and melamine resin), epoxy compounds, amine compounds (such as ethylenediamine, hexamethylenediamine, metaxylenediamine, 1,3-bisaminocyclohexane, polyoxyalkylene-type diamine and polyamine), hydrazine compounds, hydrazide compounds (such as dihydrazide adipate, carbodihydrazide and polyhydrazide) polyvalent carboxylic acid or anhydride thereof, polyisocyanate and block isocyanate.

Examples of the inorganic crosslinking agent are boric acid, borate salt (such as borax), zirconium compounds (such as halogenides, sulfate and organic acid salt), titanium compounds (such as tetraalkoxytitanate), aluminum compounds (such as aluminum sulfate, aluminum chloride and aluminum nitrate), phosphorous compounds (such as phosphite and bisphenol A modified polyphosphoric acid) and silicone compounds having a reactive functional group such as an alkoxy group or a glycidyl group. These crosslinking agents can be used alone or in a combination of two or more kinds.

Also, other paper processing agents, for example conventionally known water-soluble resin such as polyvinyl alcohol other than AAPVA (A) used in the present invention, starch and carboxymethylcellulose and water-dispersive resin such as acrylic latex and SBR latex can be added to the coating solution.

The recording medium of the present invention is obtained by applying the coating solution to the surface of a substrate. In order for the recording medium of the present invention to exhibit the effect of the present invention, using for ink jet printing is particularly preferable. Use of the recording medium of the present invention for ink jet printing is described below.

The recording medium for ink jet printing is prepared by forming an ink receiving layer by applying the coating solution on a substrate and then drying. When necessary, an overcoat layer is formed on the ink receiving layer.

The substrate is not particularly limited but examples are paper (such as board paper including manila board, white board and liner, printing paper including normal woodfree paper, ground wood printing paper and gravure paper, news print paper, release paper, carbon paper, noncarbon paper and glassine paper), nonwoven fabric, fabric, metal foil and film or sheet comprising thermoplastic resin such as polyolefin resin (including polyethylene, polypropylene, ethylene-propylene copolymer and ethylene-vinyl acetate copolymer) or polyethylene terephthalate.

As the method for applying the coating solution on the substrate, coating methods such as bar coating method, air knife coating method, blade coating method and curtain coating method can be used. The amount of the coating solution applied to the substrate is preferably approximately 0.1 to 40 $g/m^2$, more preferably 0.5 to 20 $g/m^2$ converted to solid content. To form the ink receiving layer, after applying, the coating solution is dried. The conditions for coating are not particularly limited but usually, drying is conducted at 90 to 120° C. for approximately 1 to 30 minutes.

In the case that an overcoat layer is formed on the ink receiving layer, the overcoat layer is formed by applying an aqueous solution or aqueous dispersion containing conventionally known resin such as polyvinyl alcohol, starch, carboxymethylcellulose, acrylic latex and SBR latex. When necessary, known additives such as a defoaming agent, release agent, surfactant, preservative, insecticide, antirust agent and thickening agent can be added to the aqueous solution or aqueous dispersion.

Coating and drying after coating of the overcoat layer can be conducted in the same manner as the ink receiving layer. The amount applied is preferably approximately 0.1 to 20 $g/m^2$ converted to solid content.

In the present invention, by using the coating solution containing AAPVA (A), the zirconium compound (B) and the inorganic powder (C) for an undercoat layer, a heat sensitive recording medium in which water resistance is improved can be prepared. The heat sensitive recording medium is described below.

The heat sensitive recording medium of the present invention is prepared by forming an undercoat layer by applying the coating solution to a substrate, forming a heat sensitive coloring layer and then forming an overcoat layer.

Examples of the substrate used for the heat sensitive recording medium is not particularly limited but examples are paper (such as board paper including manila board, white board and liner, printing paper including normal woodfree paper, ground wood printing paper and gravure paper, news print paper, release paper, carbon paper, noncarbon paper and glassine paper) and plastic film (such as polyester film, nylon film, polyolefin film, polyvinyl chloride film or laminate thereof).

As the method for forming the undercoat layer by applying the coating solution on the substrate, methods such as blade coating method, roll coating method, reverse roll coating method, rod blade coating method, chambrex coating method and curtain coating method can be used. The amount of the coating solution applied to the substrate is preferably approximately 1 to 20 $g/m^2$, more preferably 2 to 12 $g/m^2$ converted to solid content. To form the undercoat layer, after applying, the coating solution is dried.

The heat sensitive coloring layer is formed by preparing an aqueous solution containing a coloring substance and a developer and then applying the aqueous solution on the undercoat layer.

Examples of the coloring substance are leucos of triphenylmethane dyes such as 3,3-bis(p-dimethylaminophenyl)-phthalde, 3,3-bis(p-dimethylaminophenyl)-6-dimethylaminophthalde (crystal violet lactone), 3,3-bis(p-dimethylaminophenyl)-6-diethylaminophthalde, 3,3-bis(p-dimethylaminophenyl)-6-chlorophthalde, 3-dimethylamino-6-methoxyfluoran, 7-acetoamino-3-diethylaminofluoran, 3-diethylamino-5,7-dimethylfluoran, 3-diethylamino-5,7-dimethylfluoran, 3,6-bis-β-methoxyethoxyfluoran and 3,6-bis-β-cyanoethoxyfluoran, but are not limited thereto.

As the developer, a developer, which can color by reacting with the coloring substance when heated and liquefies or vaporizes at room temperature of higher, preferably at 70° C. or higher, is preferable. Examples are phenol, p-methylphenol, p-tertiarybutylphenol, p-phenylphenol, α-naphthol, β-naphthol, 4,4'-isopropylidenediphenol (bisphenol A), 4,4'-secondary butylidenediphenol, 4,4'-cyclohexylidenediphenol, 4,4'-isopropylidenebis(2-tertiarybutylphenol), 4,4'-(1-methyl-n-hexylidene)diphenol, 4,4'-isopropylidenedicatechol, 4,4'-benzylidenediphenol, 4,4-isopropylidenebis(2-chlorophenol), phenyl-4-hydroxybenzoate, salicylic acid, 3-phenylsalicylic acid, 5-methylsalicylic acid, 3,5-ditertiarybutylsalicylic acid, 1-oxy-2-naphthoic acid, m-oxybenzoic acid, 4-oxyphthalic acid and gallic acid, but are not limited thereto.

Coating of the heat sensitive coloring layer can be conducted by any coating method such as roll coating method, air doctor method, blade coating method, bar coating method, size press method and gate roll method. The amount applied is preferably 0.1 to 20 $g/m^2$ converted to solid content. To form the heat sensitive coloring layer, after applying, the coating solution is dried.

The overcoat layer is a layer formed on the heat sensitive coloring layer and is formed by applying an aqueous solution or aqueous dispersion containing conventionally known resin such as polyvinyl alcohol, starch, carboxymethylcellulose, acrylic latex and SBR latex. When necessary, known additives such as a defoaming agent, release agent, surfactant, preservative, insect repellent, antirust agent and thickening agent can be added to the aqueous solution or aqueous dispersion.

The overcoat layer can be coated by the same coating method as the heat sensitive coloring layer. The amount applied is preferably 0.1 to 5 $g/m^2$ converted to solid content.

Depending on the use of the heat sensitive recording medium, the overcoat layer may be omitted.

Use of the recording medium of the present invention as a recording medium for ink jet printing and heat sensitive recording medium have been described above, but other than these, the recording medium of the present invention can be used as a recording medium for recording instruments or writing instruments such as a pen plotter using water-based ink.

Hereinafter, the present invention is described in detail based on Examples. In Examples, "parts" and "%" represent weight standards unless indicated otherwise.

EXAMPLE 1

100 parts of AAPVA (A), which has a hydrolysis degree of 97.9% by mol and an average polymerization degree of 2300 and contains 4.8% by mol of acetoacetic ester groups, was dissolved in 2400 parts of water and 333 parts of inorganic powder (C) ("Finesil" available from Tokuyama Corporation, amorphous synthetic silica, shape: sphere, average particle size: 5 μm) was added thereto. The solution was mixed by stirring with a homogenizer. Then, 50 parts of an aqueous solution containing 5 parts of zirconyl hydroxychloride (B) and 100 parts of a polyamine fixing agent ("Sumirez Resin 1001" available from Sumitomo Chemical Co., Ltd.) was added and the solution was mixed to obtain the coating solution (aqueous dispersion).

Then, the obtained coating solution was applied on woodfree paper with a basic weight of 64 $g/m^2$ using a 75 μm applicator so as to become 13 $g/m^2$ converted to solid content. Then, drying was conducted in a hot air dryer at 105° C. for 10 minutes to form the ink receiving layer and the recording medium for ink jet printing was obtained.

With respect to the obtained recording medium for ink jet printing, evaluation of surface strength of the ink receiving layer, blurring when printing and water resistance after printing was conducted as described below. The results are shown in Table 1.

(Surface Strength of Ink Receiving Layer)

"Cellophane tape" (width: 18 mm) available from Nichiban Co., Ltd. was attached to the ink receiving layer surface of the obtained recording medium for ink jet printing and load was applied by rolling a hand roller (weight: 2 kg) back and forth 5 times above the tape. The tape was then peeled (test speed: 100 mm/minute) in a 180-degree direction with an autograph "AG-100" made by Shimadzu Corporation and the peeling strength (gf/mm) was measured.

(Blurring when Printing)

The obtained recording medium for ink jet printing was subjected to printing in black ink using an ink jet printer "PM-950C" made by Seiko Epson Corporation with the printing settings set to PM photograph paper. Blurring of the boundary of the printed area immediately after printing was visually observed and evaluated in the following manner.

○: Almost no blurring

X: Some blurring (Water Resistance after Printing)

The obtained recording medium for ink jet printing was subjected to printing in black ink using an ink jet printer "PM-950C" made by Seiko Epson Corporation with the printing settings set to PM photograph paper. After printing, the printed medium was left for 5 minutes under conditions of temperature of 20° C. and RH of 65%. One drop of water was dropped on the printed surface and the printed surface was rubbed strongly 5 times by finger. The condition of the ink receiving layer was visually observed and evaluated in the following manner.

○: No damage or peeling of ink receiving layer

X: Some damage or peeling of ink receiving layer

EXAMPLE 2

The recording medium for ink jet printing was obtained in the same manner as in Example 1 except that AAPVA (A), which has a hydrolysis degree of 97.9% by mol and an average polymerization degree of 1400 and contains 4.8% by mol of acetoacetic ester groups, was used as AAPVA (A). With respect to the obtained recording medium for ink jet printing, evaluation of surface strength of the ink receiving layer, blurring when printing and water resistance after printing was conducted in the same manner as in Example 1. The results are shown in Table 1.

COMPARATIVE EXAMPLE 1

The recording medium for ink jet printing was obtained in the same manner as in Example 1 except that zirconyl hydroxychloride (B) was not compounded. With respect to the obtained recording medium for ink jet printing, evaluation of surface strength of the ink receiving layer, blurring when printing and water resistance after printing was conducted in the same manner as in Example 1. The results are shown in Table 1.

COMPARATIVE EXAMPLE 2

The recording medium for ink jet printing was prepared in the same manner as in Example 1 except that inorganic powder (C) was not compounded. The obtained recording medium did not absorb any ink and when printing was conducted using a printer, the ink did not stick and printing could not be conducted. Consequently, the desired recording medium for ink jet printing could not be obtained.

TABLE 1

| | Peeling Strength (gf/mm) | Blurring | Water Resistance |
|---|---|---|---|
| Ex. 1 | 22.8 | ○ | ○ |
| Ex. 2 | 18.2 | ○ | ○ |
| Com. Ex. 1 | 1.6 | X | X |
| Com. Ex. 2 | * | * | * |

* Unable to evaluate due to lack of ink receiving properties

EXAMPLE 3

The coating solution (aqueous dispersion, pH: 2.0 (25° C.)) was obtained in the same manner as in Example 1 except that instead of 50 parts of an aqueous solution containing 5 parts of zirconyl hydroxychloride (B), 50 parts of an aqueous solution containing 5 parts of zirconyl nitrate (B) and 1 part of 1N nitric acid (D) was used.

Using the obtained coating solution, a recording medium for ink jet printing was prepared in the same manner as in Example 1 and surface strength of the ink receiving layer, blurring when printing and water resistance after printing were evaluated. The results are shown in Table 2.

EXAMPLE 4

The recording medium for ink jet printing was prepared in the same manner as in Example 3 except that instead of zirconyl nitrate (B), zirconium nitrate (B) was used and surface strength of the ink receiving layer, blurring when printing and water resistance after printing were evaluated. The results are shown in Table 2.

EXAMPLE 5

The recording medium for ink jet printing was prepared in the same manner as in Example 3 except that 0.5 part of 1N nitric acid (D) was additionally added and the pH was adjusted to 1.6 and surface strength of the ink receiving layer, blurring when printing and water resistance after printing were evaluated. The results are shown in Table 2.

EXAMPLE 6

The recording medium for ink jet printing was prepared in the same manner as in Example 3 except that AAPVA (A), which has a hydrolysis degree of 97.9% by mol and an average polymerization degree of 1400 and contains 4.8% by mol of acetoacetic ester groups, was used as AAPVA (A) and surface strength of the ink receiving layer, blurring when printing and water resistance after printing were evaluated. The results are shown in Table 2.

EXAMPLE 7

The recording medium for ink jet printing was prepared in the same manner as in Example 3 except that 0.1N sodium hydroxide was additionally added and the pH of the coating solution was adjusted to 4.0 (25° C.) and surface strength of the ink receiving layer, blurring when printing and water resistance after printing were evaluated. The results are shown in Table 2.

COMPARATIVE EXAMPLE 3

The recording medium for ink jet printing was prepared in the same manner as in Example 3 except that zirconyl nitrate (B) was not compounded, 3 parts of 1N nitric acid was added and the pH of the coating solution was adjusted to 2.0 (25° C.) and surface strength of the ink receiving layer, blurring when printing and water resistance after printing were evaluated. The results are shown in Table 2.

COMPARATIVE EXAMPLE 4

The coating solution was prepared in the same manner as in Example 3 except that inorganic powder (C) was not compounded and the pH of the coating solution was adjusted to 2.1 (25° C.). The obtained recording medium did not absorb any ink and when printing was conducted using a printer, the ink did not stick and printing could not be conducted. Consequently, the desired recording medium for ink jet printing could not be obtained.

TABLE 2

| | Peeling Strength (gf/mm) | Blurring | Water Resistance |
|---|---|---|---|
| Ex. 3 | 22.9 | ○ | ○ |
| Ex. 4 | 22.1 | ○ | ○ |
| Ex. 5 | 23.8 | ○ | ○ |
| Ex. 6 | 18.2 | ○ | ○ |
| Ex. 7 | 10.1 | X | X |
| Com. Ex. 3 | 1.0 | X | X |
| Com. Ex. 4 | * | * | * |

* Unable to evaluate due to lack of ink receiving properties

The recording medium of the present invention has a coating layer comprising (A) a polyvinyl alcohol resin containing an acetoacetic ester group, (B) a zirconium compound and (C) an inorganic powder on the surface of a substrate and in comparison to the conventional recording medium, the surface strength of the coating layer is high. Also, with respect to the recording medium of the present invention, ink blurring does not occur when printing and water resistance after printing is excellent. Therefore, the recording medium of the present invention is extremely useful as a recording medium for ink jet printing.

What is claimed is:

1. A process for preparing a recording medium, comprising:

a step of preparing a coating solution comprising a polyvinyl alcohol resin containing an acetoacetic ester group (A), a zirconium compound (B) and an inorganic powder (C), and a step of applying said coating solution to a surface of a substrate, wherein said zirconium compound (B) is zirconyl hydroxychloride, and wherein the hydrolysis degree of said polyvinyl alcohol resin containing an acetoacetic ester group is at least 70% by mol.

2. The process for preparing a recording medium of claim 1, wherein polymerization degree of said polyvinyl alcohol resin containing an acetoacetic ester group (A) is at least 300.

3. The process for preparing a recording medium of claim 1, which further comprises a step of preparing the polyvinyl alcohol resin containing an acetoacetic ester group (A) by reacting a polyvinyl alcohol resin and a diketene, before said step of preparing said coating solution.

* * * * *